US012011098B2

(12) United States Patent
Gomez

(10) Patent No.: US 12,011,098 B2
(45) Date of Patent: Jun. 18, 2024

(54) CUSHION WITH PRESSURE-RELIEVING BILOBATE APERTURE

(71) Applicant: Cynthia Gomez, Petaluma, CA (US)

(72) Inventor: Cynthia Gomez, Petaluma, CA (US)

( * ) Notice: Subject to any disclaimer, the term of this patent is extended or adjusted under 35 U.S.C. 154(b) by 50 days.

(21) Appl. No.: 17/889,293

(22) Filed: Aug. 16, 2022

(65) Prior Publication Data

US 2024/0057773 A1 Feb. 22, 2024

(51) Int. Cl.

| | |
|---|---|
| ***A47C 7/02*** | (2006.01) |
| ***A47C 7/14*** | (2006.01) |
| ***A47C 7/18*** | (2006.01) |
| *A47C 27/14* | (2006.01) |

(52) U.S. Cl.

CPC ..... *A47C 7/0213* (2018.08); *A47C 7/021* (2013.01); *A47C 7/18* (2013.01); *A47C 27/148* (2013.01)

(58) Field of Classification Search

CPC ..... A47C 7/0213; A47C 7/18; A47C 7/021; A47C 7/029; A47C 27/148

USPC ..... 297/219.1, 284.3, 452.22, 452.27

See application file for complete search history.

(56) References Cited

U.S. PATENT DOCUMENTS 1,742,186 A * 1/1930 Rudolph ..... A47C 7/029 5/653
2,933,738 A * 4/1960 Whelan ..... A47C 20/027 5/630
3,158,878 A * 12/1964 Pernell ..... A61G 7/05723 128/889
3,987,507 A * 10/1976 Hall ..... A61G 5/1091 5/653
4,132,228 A * 1/1979 Green ..... A47C 7/029 297/284.3 X
4,682,818 A * 7/1987 Morell ..... A61G 5/1045 297/452.27 X
4,753,480 A * 6/1988 Morell ..... A61G 7/05715 297/452.27 X
4,824,174 A 4/1989 Dunn
(Continued)

FOREIGN PATENT DOCUMENTS

DE 202006015224 U1 * 3/2007 ..... A47C 27/085
WO WO-0128388 A1 * 4/2001 ..... A47C 7/029

OTHER PUBLICATIONS

"Etsy inflatable BBL mattress.pdf", Internet web page from address: https://www.etsy.com/listing/986655609/bblmattress ?ga_order=most_relevant&ga_search_type=all&ga_view_type=gallery&ga_search_query=bbl+mattress&ref=sr_gallery-1-1&organic_search_click=1&frs=1; Original publication date unknown , but prior to Jul. 14, 2021.

*Primary Examiner* — Rodney B White
(74) *Attorney, Agent, or Firm* — GSS Law Group; Gregory S. Smith; Philip Wagner

(57) ABSTRACT

A cushion assembly for supporting a sitting or reclining person includes a cushion formed with a cushion aperture. The person may suspend a part of their body within the void space of the cushion aperture to avoid contact pressure between the cushion assembly and the suspended body part. An optional cushion insert may be positioned in the cushion aperture. The cushion insert is formed with a bilobate insert aperture and an insert ridge projecting into the insert aperture has a first insert aperture lobe extending away from a first side of the insert ridge and a second insert aperture lobe extending away from a second side of the insert ridge. The cushion insert modifies a size and perimeter shape of the void space in the cushion aperture.

16 Claims, 8 Drawing Sheets

(56) References Cited

U.S. PATENT DOCUMENTS 4,840,362 A * 6/1989 Bremer ..... A61G 13/0054 5/632
5,282,286 A * 2/1994 MacLeish ..... A61G 5/1045 5/655.3
5,414,884 A * 5/1995 Mackenzie ..... A61G 5/1043 5/653
5,522,106 A * 6/1996 Harrison ..... A61G 5/1045 297/452.27 X
6,135,550 A * 10/2000 Tucho ..... B62J 1/26 297/284.3
6,241,320 B1 * 6/2001 Chew ..... A47C 7/021 297/452.26 X
6,739,008 B1 * 5/2004 Kindrick ..... A47C 27/146 5/730
6,854,144 B1 * 2/2005 Mehring, Jr. ..... A47C 27/20 5/722
D546,106 S * 7/2007 Haile ..... D6/601
7,373,678 B2 5/2008 Hetzel
7,445,292 B2 * 11/2008 Moule ..... B60N 2/643 297/452.27 X
D583,179 S * 12/2008 Haile ..... D6/601
D583,180 S * 12/2008 Haile ..... D6/601
7,614,704 B2 * 11/2009 Whelan ..... A61G 5/1043 297/452.27 X
8,291,535 B2 * 10/2012 Kemper ..... A61G 5/1045 297/452.27 X
8,387,186 B2 * 3/2013 Yu ..... A47C 3/16 297/219.1
8,566,987 B1 10/2013 Burge
D713,665 S 9/2014 Caforio
D722,449 S 2/2015 Krishtul
9,220,345 B2 12/2015 Davis
9,357,864 B2 6/2016 Campagna
9,993,086 B2 6/2018 Harte
D845,675 S * 4/2019 Yang ..... D6/601
2017/0000264 A1 1/2017 Krishtul
2018/0035813 A1 * 2/2018 Fukuda ..... G01D 5/145

* cited by examiner

Section A-A

Alternate
Section A-A

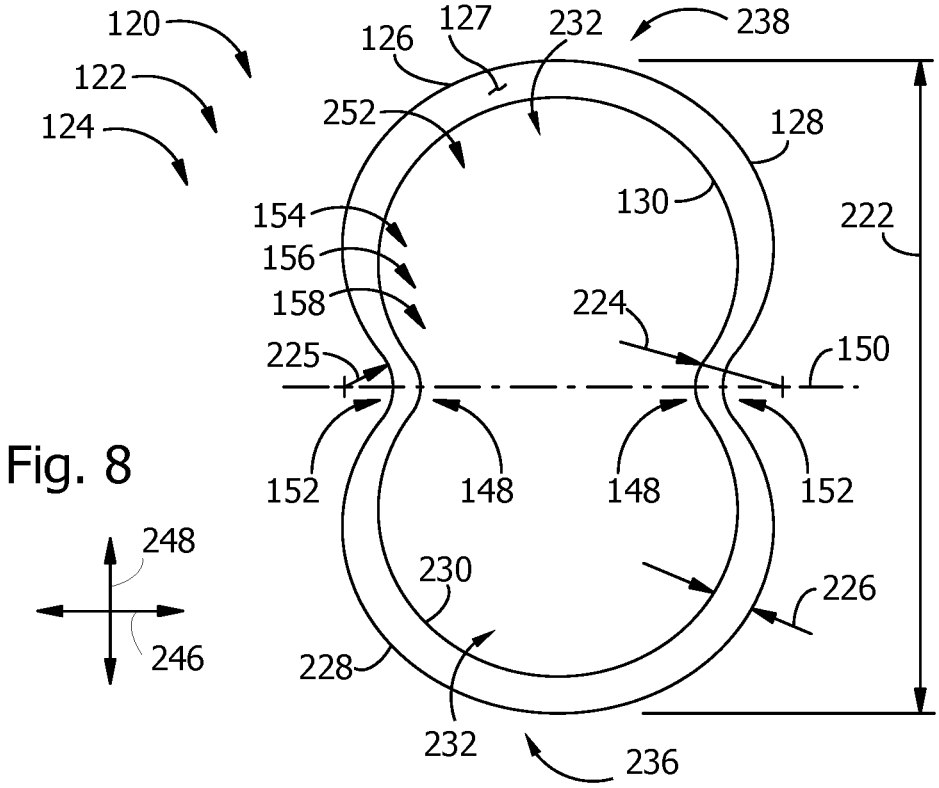
Fig. 8
Fig. 9 Section B-B
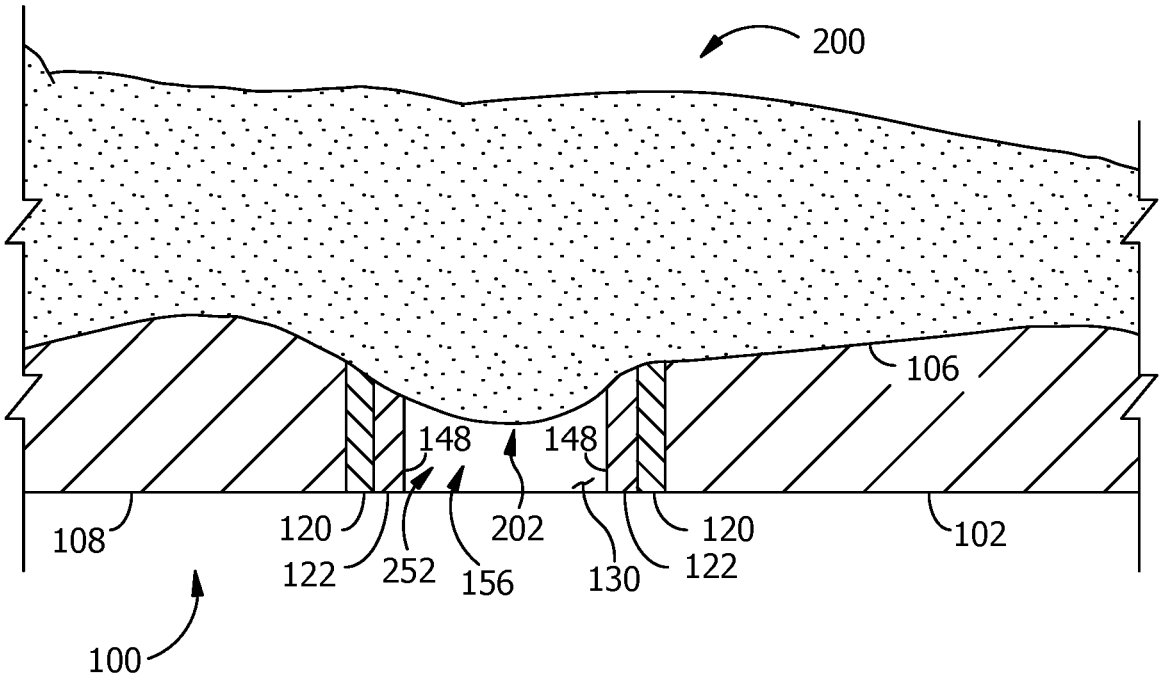

CUSHION WITH PRESSURE-RELIEVING BILOBATE APERTURE

FIELD OF THE INVENTION

Embodiments are related to cushions configured to support a reclining person's body without contact between the cushion and selected parts of the person's body.

BACKGROUND

Some medical procedures using incisions, abrasion, electromagnetic radiation, thermal energy, acoustic energy, or injections may lead to swelling or inflammation of part of a person's body. Swelling or inflammation may also result from illness, infection, trauma, implants, or other conditions. It may be preferable to avoid applying contact pressure to the inflamed or swollen area for a period of time from a few hours to several weeks to enable a person to rest comfortably and to support recovery of the affected area.

For a person who has experienced trauma or had a medical procedure performed in the gluteal region of the body, sitting on an ordinary seat cushion or sleeping on one's back on an ordinary mattress may cause uncomfortable or medically disadvantageous contact pressure between the cushion or mattress and the inflamed or swollen gluteal region. The gluteal region may be considered to include parts of the body posterior to the pelvic girdle between the lower back and the perineum, for example the left and right gluteal muscles and nearby skin, adipose tissue, ligaments, arteries, veins, and nerves. The gluteal region may also be referred to as the buttocks.

For a person who has possibly had a procedure performed in the gluteal region and/or one or more procedures performed in the area of the chest, abdomen, or breasts, sleeping on one's stomach may case uncomfortable or medically disadvantageous contact pressure between a cushion or mattress and the inflamed or swollen area.

SUMMARY

Example apparatus embodiments of a cushion assembly for supporting a sitting or reclining person include a cushion having a cushion top surface and a cushion bottom surface. The cushion is formed with a cushion aperture extending through the cushion top surface toward said cushion bottom surface. The cushion assembly includes an optional cushion insert configured for insertion into the cushion aperture.

The cushion insert includes an insert wall configured to fit within the cushion aperture. The cushion insert includes an insert wall top surface; an insert wall bottom surface, with the insert wall formed with a bilobate insert aperture extending through the insert wall top surface toward the insert wall bottom surface; and an insert wall ridge projecting into the bilobate insert aperture, with the insert wall ridge extending from the insert wall top surface toward the insert wall bottom surface.

The bilobate insert aperture is preferably formed with a first insert aperture lobe extending transversely away from a first side of the insert wall ridge and a second insert aperture lobe extending transversely away from a second side of the insert wall ridge opposite the first side.

In some cushion assembly embodiments, the cushion aperture is formed with a rectangular cushion aperture perimeter and the insert wall is formed with a rectangular insert wall outer perimeter configured to fit within the cushion aperture. The cushion aperture may alternatively be formed with an obround cushion aperture perimeter and the insert wall formed with an obround insert wall outer perimeter configured to fit within the cushion aperture.

The cushion optionally further includes a cushion ridge projecting into the cushion aperture from the cushion top surface toward the cushion bottom surface. The cushion optionally further includes a second cushion ridge projecting into the cushion aperture from the cushion top surface toward the cushion bottom surface, with the cushion ridge and the second cushion ridge on longitudinally opposite sides of the cushion aperture.

The cushion insert optionally further includes an insert wall outer surface formed with a channel extending from the insert wall top surface toward the insert wall bottom surface, and with the channel positioned to receive the cushion ridge. The cushion ridge, the insert wall ridge, and the channel are preferably positioned on a longitudinal centerline of the cushion aperture when the cushion insert is positioned in the cushion aperture.

The cushion aperture is optionally formed with a bilobate cushion aperture perimeter and the insert wall is formed with a bilobate insert wall outer perimeter configured to fit within the cushion aperture. The cushion aperture formed with a bilobate aperture perimeter is further formed with a first cushion aperture lobe extending transversely away from a first side of the cushion ridge and a second cushion aperture lobe extending transversely away from a second side of the cushion ridge opposite the first side. The cushion aperture optionally extends through the cushion bottom surface The cushion insert optionally includes a second insert wall ridge projecting into the bilobate insert aperture, with the second insert wall ridge extending from the insert wall top surface toward the insert wall bottom surface, and the insert wall ridge and the second insert wall ridge positioned on longitudinally opposite sides of the bilobate insert aperture.

A cushion assembly optionally further includes a releasable fastener affixed to the cushion; and a complementary releasable fastener affixed to the insert wall with the complementary releasable fastener positioned to engage with the releasable fastener.

In some cushion assembly embodiments, the bilobate insert aperture has an inner surface with a vertical dimension less than a vertical dimension of the cushion. Alternately, the bilobate insert aperture has an inner surface with a vertical dimension approximately equal to a vertical dimension of said cushion.

For some cushion assembly embodiments, the cushion insert is a first cushion insert, and the cushion assembly further includes a second cushion insert positioned with an insert wall outer surface of the second cushion insert in contact with an inner surface of the bilobate insert aperture of the first cushion insert.

BRIEF DESCRIPTION OF THE DRAWINGS

FIG. 8 is a view downward onto the top side of an example cushion insert having a bilobate insert wall outer perimeter, a channel formed in the insert wall outer surface, and insert wall ridges projecting into the bilobate insert aperture from longitudinally opposite sides of the bilobate insert aperture.

FIG. 9 is a partial cross-sectional view B-B showing an example cushion assembly with two nested cushion inserts and part of the torso and legs of a person reclining against the top sides of the cushion and cushion inserts. A location and viewing direction for the cross section is marked by a section line B-B in FIG. 2.

FIG. 12 further represents an example of a person sitting on the example cushion of FIG. 1 without the use of a cushion insert in the cushion.

DESCRIPTION

Figure 1:
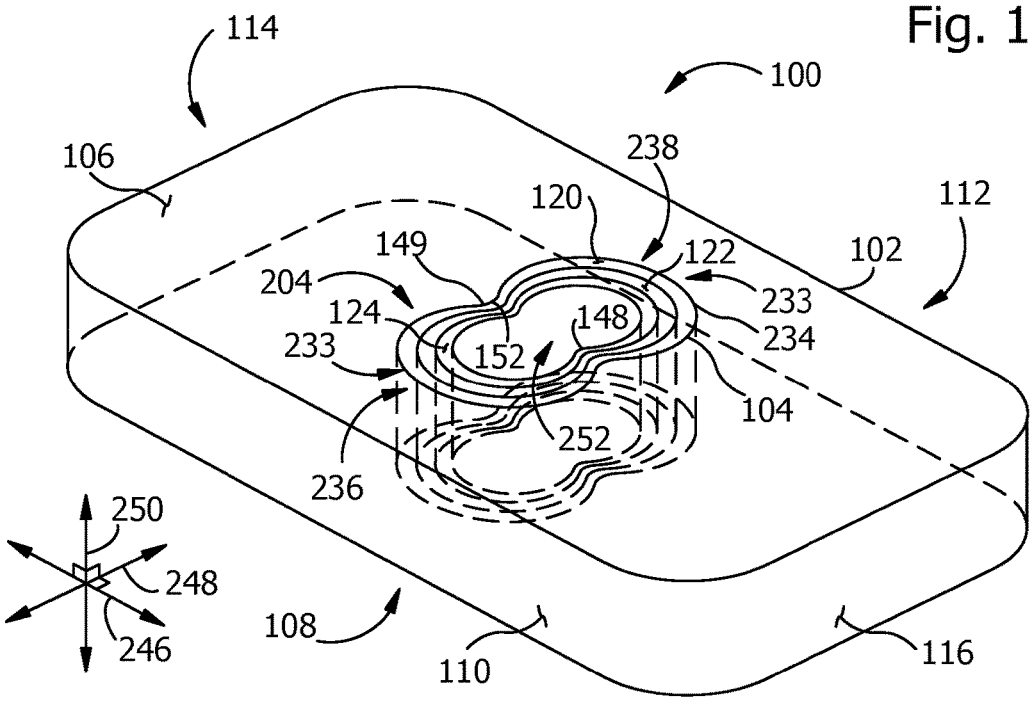
FIG. 1 is a pictorial view of an example embodiment of a cushion assembly having a cushion formed with a cushion aperture and a set of three nested cushion inserts positioned in the cushion aperture.

Example embodiments of a cushion assembly are configured for providing comfortable support for a person sitting or reclining on the cushion assembly while providing for parts of the person's body to be suspended in a cushion aperture formed in the cushion assembly. At least one optional cushion insert is included with the cushion assembly to modify a perimeter shape and length and width dimensions of the cushion aperture, enabling adjustment of the cushion assembly to accommodate different body sizes and personal comfort preferences. The cushion insert includes an insert wall formed with a bilobate insert aperture shaped to admit parts of the person's body into two adjacent aperture lobes demarcated from one another by at least one intervening insert wall ridge. A cushion assembly optionally includes another, smaller cushion insert having an outer perimeter configured to fit within the inner perimeter of the outer, larger cushion insert.

A person using the cushion assembly will preferably position a swollen, inflamed, or pressure-sensitive part of the body, for example a treatment area that has been subjected to a medical procedure, in the void space of the cushion aperture with parts of the body outside the treatment area supported against the cushion and any installed cushion inserts. The cushion is optionally formed with a cushion ridge projecting into the cushion aperture from the top surface toward the bottom surface of the cushion. The cushion ridge is optionally positioned on the longitudinal centerline of the cushion aperture. A second cushion ridge may optionally be formed on a longitudinally opposite side of the cushion aperture from the first cushion ridge. Each of the cushion inserts have a wall surrounding a void space divided into two lobes by an insert wall ridge extending into the void space. The cushion ridge and insert wall ridges are positioned to nest into a channel formed on an outer surface of an adjacent cushion insert.

The ridges on the cushion assembly, for example the cushion ridges on the cushion and the insert wall ridges on each cushion insert, are positioned on a longitudinal centerline of the cushion aperture to press gently with equal pressure against both sides of the intergluteal cleft on a person's body when the buttocks are correctly positioned in the cushion aperture. The ridges provide tactile feedback to aid in guiding the person in positioning the median plane of their body on the longitudinal centerline of the cushion aperture. The median plane may also be referred to as the midsagittal plane. For a person resting on their stomach, the ridges provide light contact pressure against both sides of the intermammary cleft to guide the person in centering the median plane of their body on the cushion aperture. Centering the median plane of the body on the longitudinal centerline of the cushion aperture avoids contact pressure against swollen or inflamed areas of the body suspended in the cushion aperture. Tactile feedback from the ridges enables the person to accomplish the centering without the person seeing what they are doing, for example in a darkened room or when parts of the body are covered by clothing or a sheet or blanket.

Embodiments of the cushion assembly are effective for relieving contact pressure against a person's buttocks by enabling the person to position their buttocks within the cushion aperture without an inflamed or sensitive area on the buttocks contacting other parts of the cushion assembly. The cushion and cushion inserts are preferably made with a thickness dimension, a compression strength, and an elasticity sufficient to prevent contact between the parts of the body suspended in the cushion aperture and an object upon which the cushion assembly is placed. The example cushion assembly embodiments are further advantageous for allowing a person to sleep on their stomach while relieving contact pressure against the person's breasts. Some cushion assembly embodiments are sufficiently long to provide support for the person's head and legs while the person reclines with their buttocks suspended within the void space of the cushion aperture. Some cushion assembly embodiments include arm rests, a head rest, and/or a leg rest.

Example embodiments of a cushion assembly 100 are shown in the figures. As suggested in FIG. 1 and FIG. 2, the example cushion assembly 100 includes a cushion 102, at least one optional removable cushion insert 120, and two optional additional cushion inserts (122, 124) nested within one another inside a cushion aperture 104 formed in the cushion. The cushion aperture 104 extends through the cushion top surface 106 toward the cushion bottom surface 108, forming a void space 252 into which a part of a person's body may be suspended. The cushion aperture 104 extends through the cushion bottom surface 108 in some embodiments 100. The cushion inserts, optionally provided as a set 204 of nesting inserts, provide for incremental adjustment of the dimensions of the void space 252 in the cushion 102. A cushion assembly 100 may alternatively include a different number of cushion inserts than shown in the figures.

The cushion 102 has a generally rectangular outer perimeter shape as shown in the examples of FIGS. 1, 2, 5, 6, and 7. The cushion is optionally formed with rounded corners. The example cushion 102 includes a cushion top surface 106 against which a person may sit or recline and a cushion bottom surface 108 on a side opposite in a vertical direction from the cushion top surface. The cushion bottom surface 108 may be placed on a floor, a seat in a vehicle, or an article of furniture such as a bed or chair. The top surface and bottom surface are joined to, or alternately integrally formed with, a first longitudinal side 110 extending in a longitudinal direction 246 from a first transverse side 114 at an end of the cushion 102 to a second transverse side 116 at an opposite end of the cushion. A second longitudinal side 112 is joined to the cushion top surface 106, cushion bottom surface 108, first transverse side 114, and second transverse side 116 on a side opposite the first longitudinal side 110. The first longitudinal side 110, second longitudinal side 112, first transverse side 114, and second transverse side 116 extend in a vertical direction from the cushion bottom surface 108 to the cushion top surface 106.

The cushion 102 may be made as a box cushion from separate pieces of fabric and/or padding or may alternately be formed as a unitary structure. The interior volume of the cushion 102, excluding the void space 252 within the cushion aperture 104, may be filled with a padding material such as cotton batting, sheets or blocks of polymer foam, quilted material, felted material, and/or other materials suitable for use in making seat cushions and mattresses. The cushion may optionally be integrally formed from a single piece of closed-cell or open-cell polymer foam, with the cushion aperture 104 formed by cutting into a sheet of polymer foam or by molding the cushion to its final form including the cushion aperture.

The cushion 142 may be formed with a longitudinal dimension 142, also referred to as a length dimension 142, selected to permit an adult person of average height to recline against the cushion assembly with the shoulders and thighs supported against the cushion top surface 106. The cushion may be formed with a transverse dimension 144, also referred to as a width dimension 144, selected to permit an adult person of average body size to recline against the cushion assembly 100 without the torso and/or thighs extending beyond the first longitudinal side 110 and the second longitudinal side 112. The cushion may optionally be made with length 142 and width 144 dimensions corresponding to commercially available bed mattress sizes.

Figure 3:
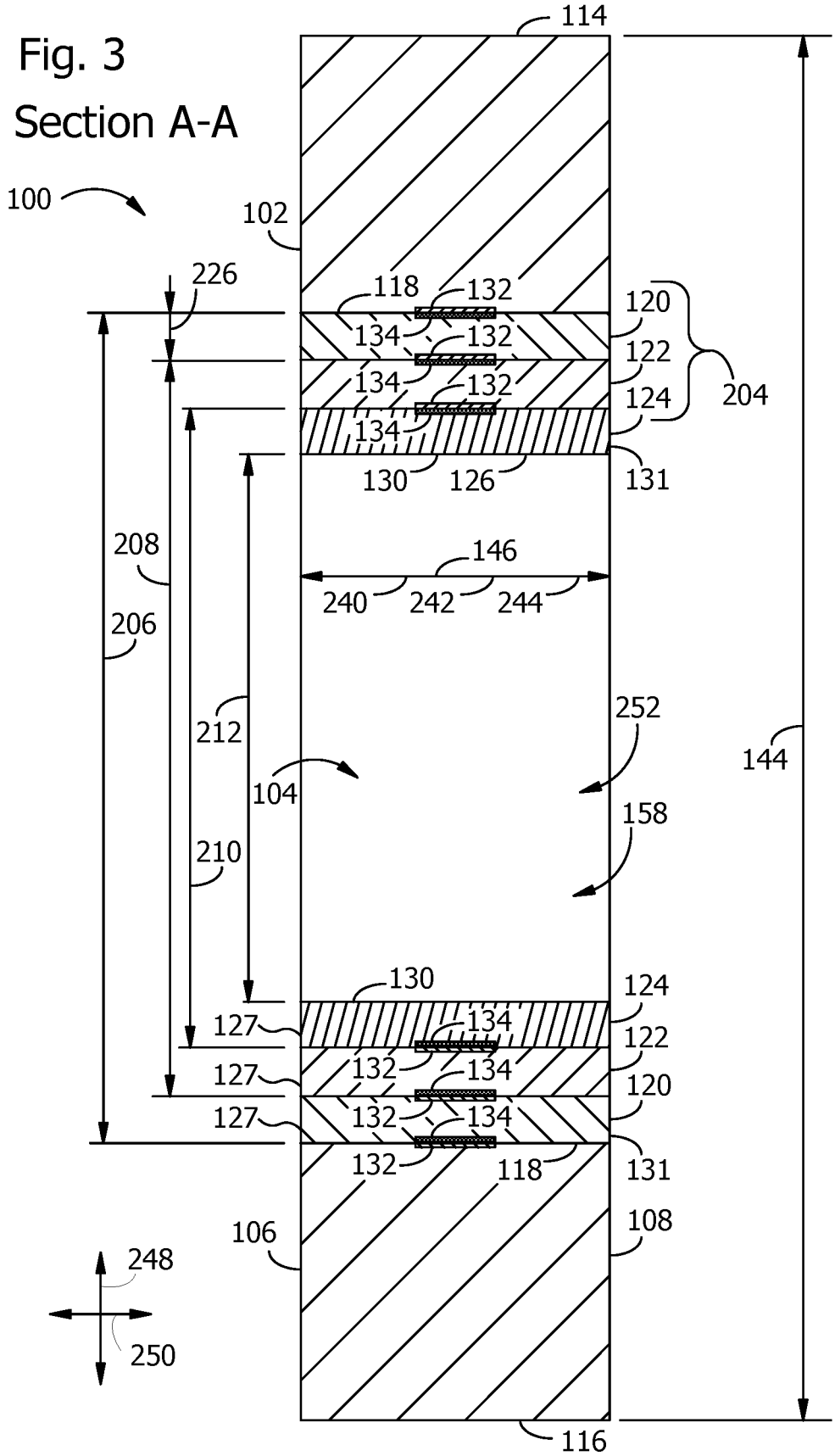
FIG. 3 is a cross-sectional view A-A of the example cushion assembly and nested cushion inserts of FIGS. 1-2. A location and viewing direction for the cross section is marked by a section line A-A in FIG. 2.

The perimeter 234 of the cushion aperture 104 is optionally formed with a first cushion ridge 149 projecting into the void space 252 of the cushion assembly 100 and an optional second cushion ridge 149 projecting into the void space toward the first cushion ridge from a longitudinally opposite side of the cushion aperture. The perimeter 234 corresponds to the intersection of an interior surface 118 (ref. FIG. 3) of the cushion aperture 104 with the cushion top surface 106. The first cushion ridge 149 and optional second cushion ridge 149 extend in a vertical direction 250 from the cushion top surface 106 toward the cushion bottom surface 108. In some embodiments the first and second cushion ridges extend all the way to the cushion bottom surface 108. As will be described in more detail with regard to FIG. 8, a longitudinal centerline 150 of the cushion aperture 104 optionally passes through the center of the radius of curvature of the cushion ridge(s).

The longitudinal centerline 150 is preferably defined with respect to the positions of the cushion ridges rather than the outer dimensions of the example cushion 102. The cushion aperture may optionally be positioned with a longitudinal offset and/or a transverse offset relative to the longitudinal and/or transverse midpoints of the outer perimeter dimensions of the cushion 102.

Figure 10:
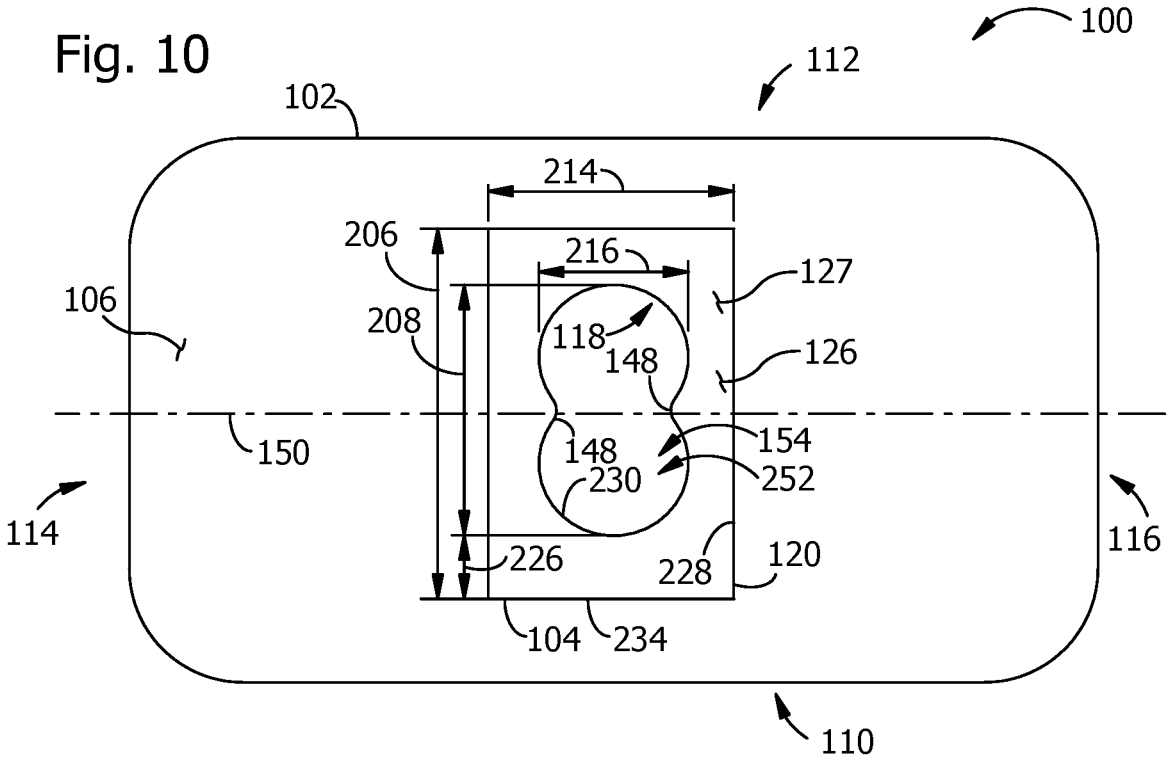
FIG. 10 is a view downward onto the top side of an example cushion assembly having a cushion formed with a rectangular cushion aperture and a cushion insert formed with a rectangular outer perimeter and a bilobate insert aperture.
Figure 11:
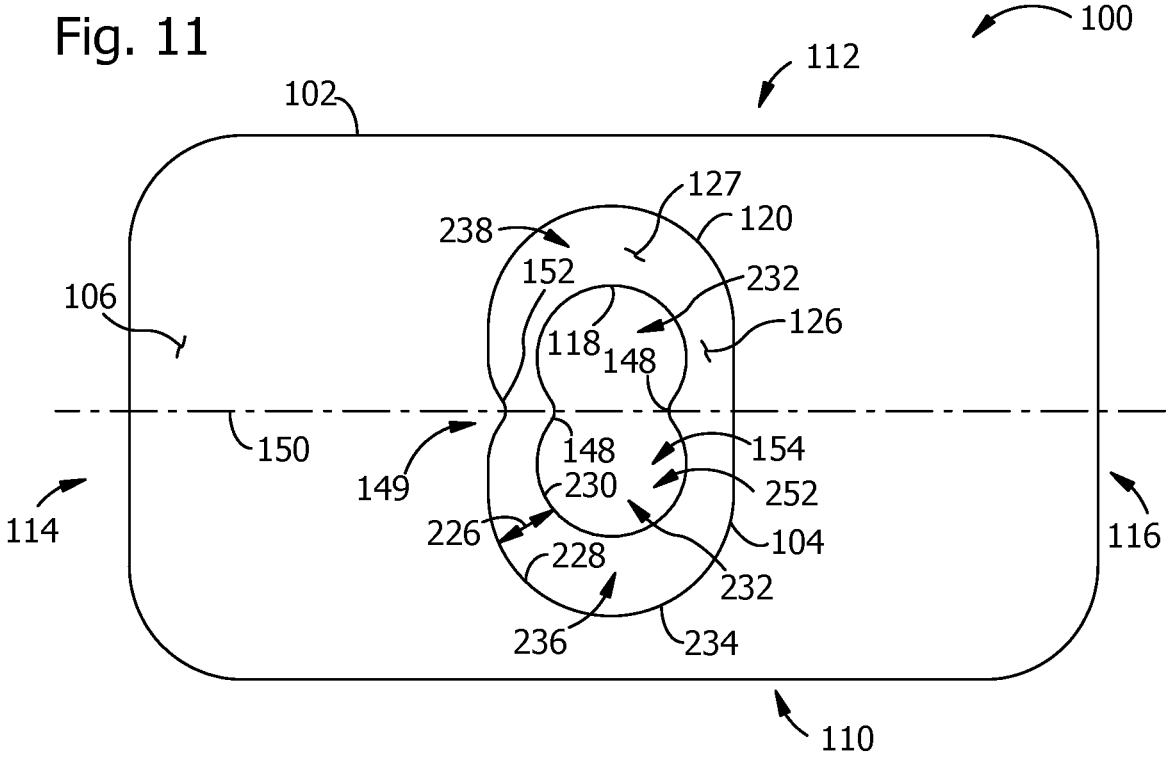
FIG. 11 is a view downward onto the top side of an example cushion assembly having a cushion formed with an obround cushion aperture, an optional cushion ridge projecting into the cushion aperture, and a cushion insert formed with an obround outer perimeter, a bilobate insert aperture, and a channel positioned to receive the cushion ridge.

In some embodiments 100, the perimeter 234 of the cushion aperture is further formed with a first arcuate cushion aperture lobe 233 extending in a transverse direction 248 from the cushion ridge 149 on a first transverse side 236 of the cushion ridge and a second arcuate cushion aperture lobe 233 extending in a transverse direction 248 from the cushion ridge on a second transverse side 238 opposite the first transverse side. Alternatively, the perimeter 234 of the cushion aperture may be formed with a rectangular shape, an obround shape, or other shapes, as will be explained in more detail with regard to FIG. 10 and FIG. 11.

FIG. 3 shows examples of some additional features of the cushion 102 and cushion inserts (120, 122, 124). Each of the cushion inserts includes an insert wall 126 surrounding a cushion insert aperture configured to receive the optional next-smaller cushion insert. When no cushion inserts are installed, the void space 252 within the cushion aperture 104 has a first transverse dimension 206. When a first cushion insert 120 is installed in the cushion aperture 104, the void space 252 is reduced to a second transverse dimension 208 smaller than the first transverse dimension 206. When an optional second cushion insert 122 is installed with its insert wall 126 against the insert wall of the first cushion insert 120, the void space is reduced to a third transverse dimension 210 smaller than the second transverse dimension 208. When an optional third cushion insert 124 is installed with its insert wall 126 against the insert wall of the second cushion insert 122, the void space is reduced to a fourth transverse dimension 212 smaller than the third transverse dimension 210. The insert walls of the cushion inserts are optionally all made with a same wall thickness 226 or may alternatively be made with different wall thicknesses from one another.

Figure 7:
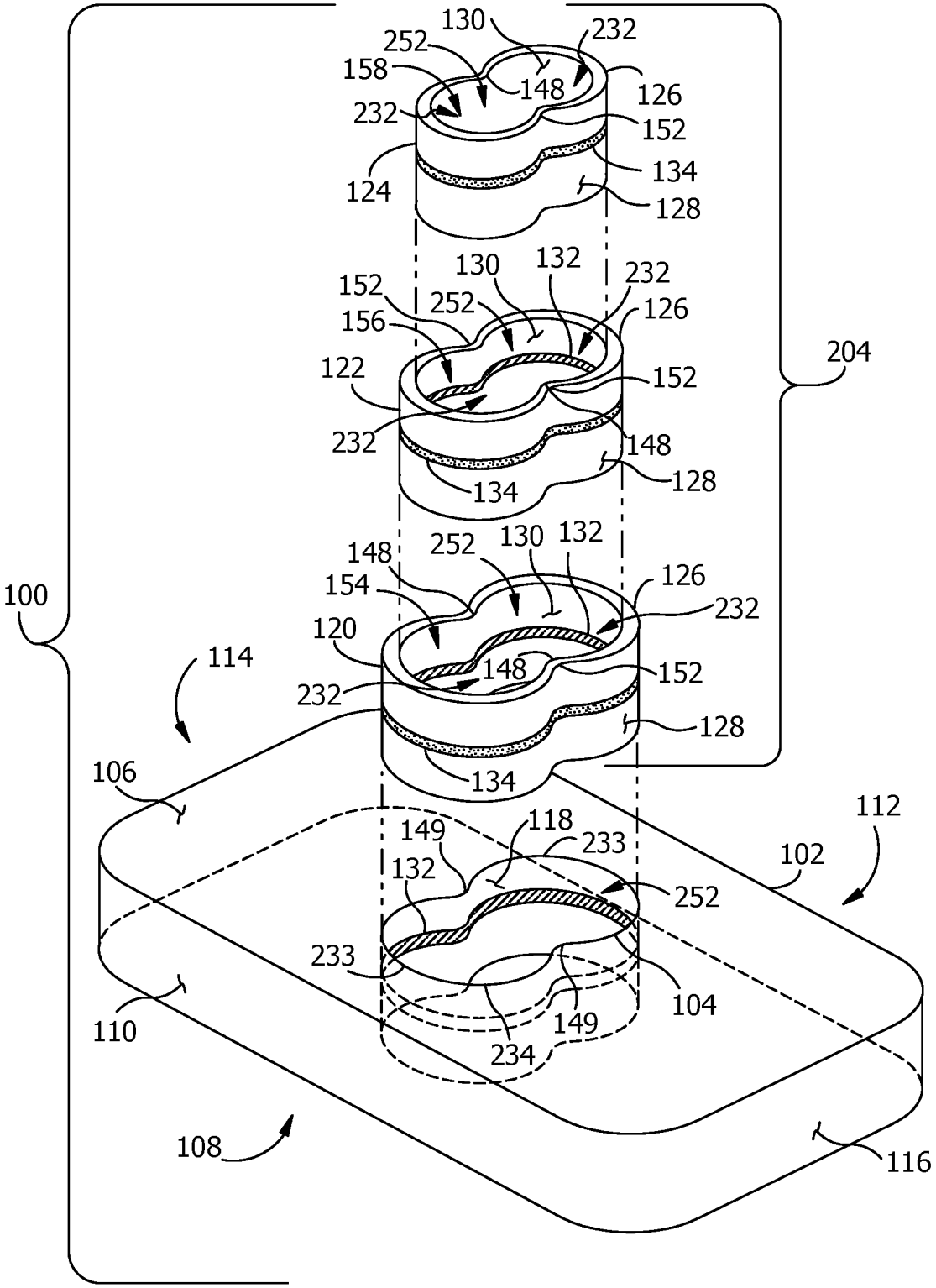
FIG. 7 is an exploded pictorial view of an example embodiment of a cushion assembly including the cushion with a bilobate cushion aperture and three example cushion inserts configured to nest within one other to adjust longitudinal and transverse dimensions of the void space within the cushion aperture.

The cushion inserts are optionally attachable to one another by releasable fasteners. FIG. 3 and FIG. 7 show example embodiments 100 having cushion inserts attachable to one another by optional releasable fasteners. FIGS. 1, 2, 4, and 9 represent examples of embodiments omitting the releasable fasteners. Examples of releasable fasteners include, but are not limited to, hook-and-loop fastener material, snaps, and zippers. For example, a releasable fastener 132 affixed to the interior surface 118 of the cushion aperture 104 may be positioned to attach to a complementary releasable fastener 134 on an exterior surface of the insert wall 126 of the first cushion insert 120. Another releasable fastener 132 affixed to the interior surface of the insert wall of the first cushion insert may be positioned to attach to another complementary releasable fastener on an exterior surface of the insert wall of the second cushion insert 122, and so on for the number of inserts included in a set of nesting inserts 204. An embodiment 100 optionally includes a different number of releasable fasteners and complementary releasable fasteners than are shown in the illustrated examples and/or having different sizes and shapes than the examples in the figures.

The cushion inserts in the example of FIG. 3 are positioned with an insert wall bottom surface 131 on each cushion insert approximately coplanar with the cushion bottom surface 108 and an insert wall top surface 127 on each insert approximately coplanar with the cushion top surface 106. A height dimension 240 of the first cushion insert 120, a height dimension 242 of the second cushion insert 122, and a height dimension 244 of the third cushion insert 124 are approximately equal to a height dimension 146 of the cushion 102 from the cushion bottom surface 108 to the cushion top surface 106, where "approximately equal" refers to a tolerance of plus-or-minus 0.1 inch (2.5 millimeters).

Figure 4:
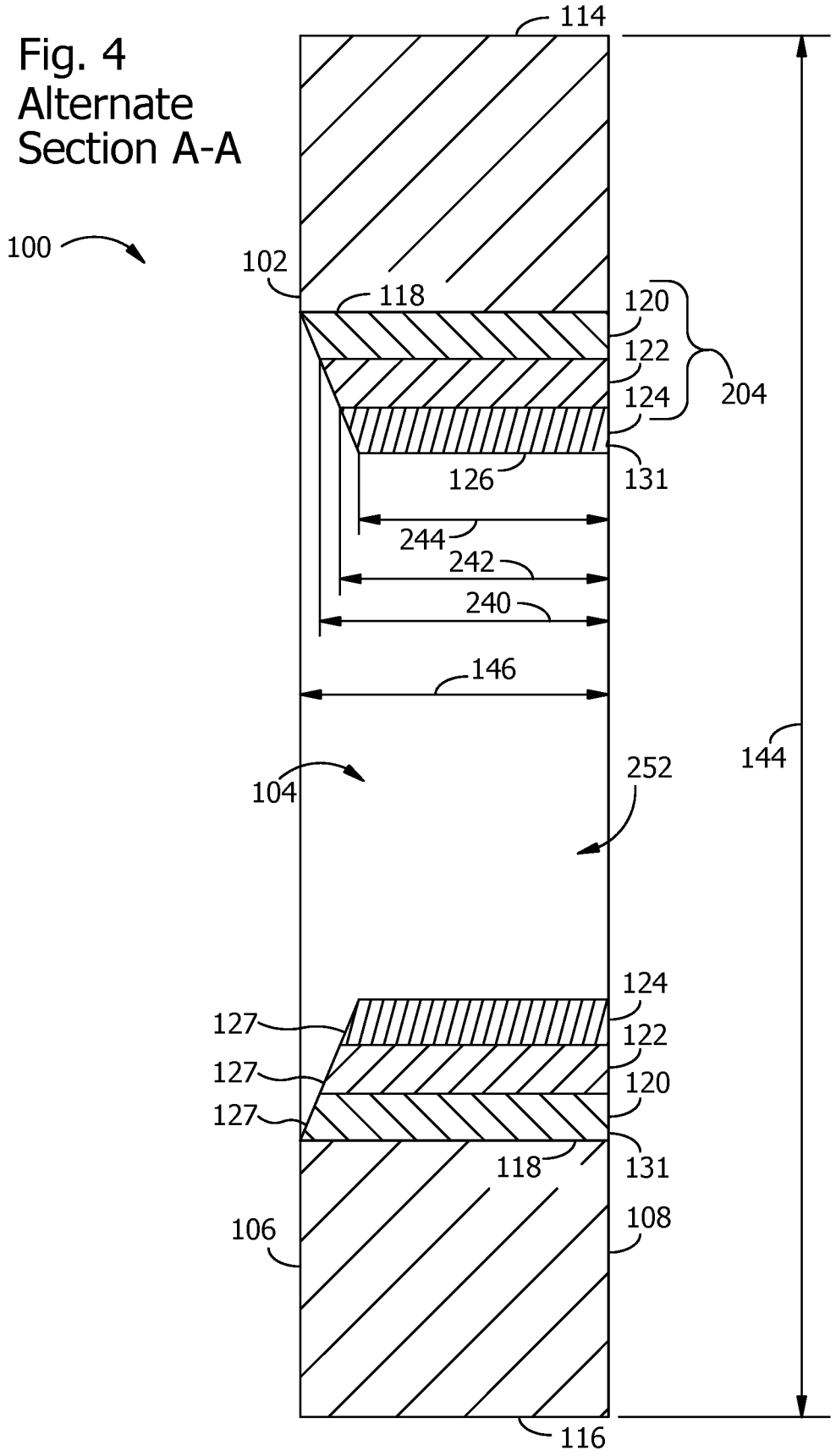
FIG. 4 is an alternative cross-sectional view A-A showing examples of nested cushion inserts having height dimensions that differ from one another.

FIG. 4 shows an example alternative embodiment 100 in which the insert walls 126 have different heights from one another, with a height dimension for a cushion insert less than a corresponding height dimension for the next-outermost cushion insert. For example, FIG. 4 shows an example embodiment 100 having the height dimension 240 of the first cushion insert 120 greater than the height dimension 242 of the second cushion insert 122, which is in turn greater than the height dimension 244 of the third cushion insert 124. The insert wall top surfaces 127 may be arranged to form a sloped surface descending from the cushion top surface 106 toward the void space 252, or may alternatively be formed as stepped surfaces.

Figure 5:
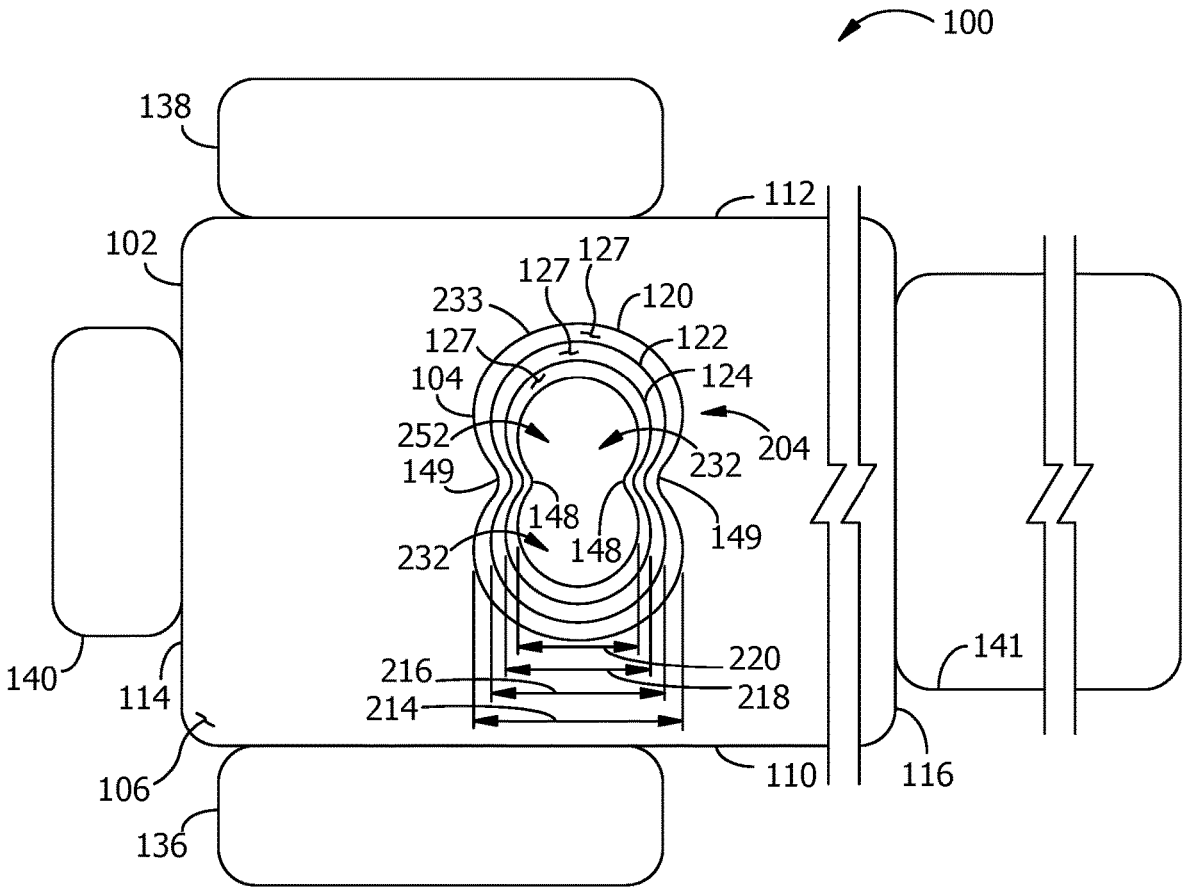
FIG. 5 is a view downward toward the top surface of the example cushion assembly of FIGS. 1-3, showing examples of optional arm rests, an optional head rest, and an optional leg rest attached to the cushion.

As suggested in the example of FIG. 5, when no cushion inserts are installed, the void space 252 established by the cushion aperture 104 has a first longitudinal dimension 214. When the first cushion insert 120 is installed in the cushion assembly 100 with the insert wall outer surface 128 in contact with the interior surface 118 of the cushion aperture 104, the void space 252 is reduced to a second longitudinal dimension 216 smaller than the first longitudinal dimension 214. When an optional second cushion insert 122 is installed with insert wall outer surface 128 against the insert wall inner surface 130 of the first cushion insert 120, the void space is reduced to a third longitudinal dimension 218 smaller than the second longitudinal dimension 216. When an optional third cushion insert 124 is installed with its insert wall 126 against the insert wall of the second cushion insert 122, the void space is reduced to a fourth longitudinal dimension 220 smaller than the third longitudinal dimension 218.

Figure 6:
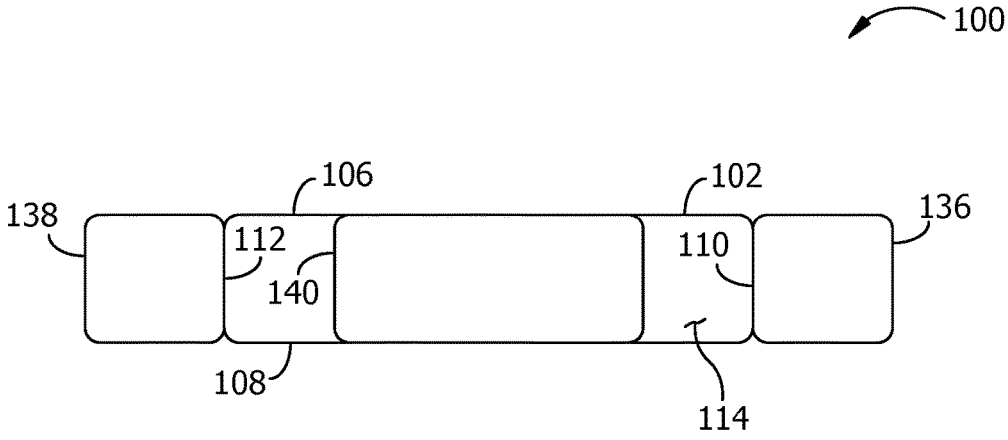
FIG. 6 is an end view toward the optional head rest of the example cushion assembly of FIG. 5.

The same example of a cushion 102 appears in FIGS. 1-7 and FIG. 9. FIG. 5 and FIG. 6 further show examples of two optional arm rests, an optional head rest 140, and an optional leg rest 141 which may be provided as removably attachable accessories to the cushion 102. An optional right arm rest 136 is removably attachable to the first longitudinal side 110. An optional left arm rest 138 is removably attachable to the second longitudinal side 112. The optional head rest 140 is removably attachable to the first transverse side 114. The optional leg rest 141 is removably attachable to the second transverse side 116. Removable attachments between the head rests, arm rests, leg rest, and the cushion may use hook-and-loop fastener material, snaps, zippers, or other readily separable fasteners. Alternatively, the head rest 140 arm rests (136, 138), and/or leg rest 141 may be affixed to the cushion 102 or formed as an integral part of the cushion.

FIG. 7 shows example features of the cushion assembly 100 from FIGS. 1-6 in an exploded pictorial view. The interior surface 118 of the cushion aperture 104 in the cushion 102 intersects the cushion top surface 106 at the perimeter 234 of the aperture 104. The optional first and second cushion ridges 149 extend toward one another from opposite longitudinal sides of the interior surface 118 into the void space 252 of the cushion aperture. In some embodiments 100, the cushion aperture 104 is formed with two arcuate cushion aperture lobes 233 extending outward from opposite transverse sides of the cushion ridges 149. As will be discussed in more detail with regard to FIG. 10 and FIG. 11, a cushion aperture 104 may alternatively be formed with rectangular, obround, or other perimeter shapes.

FIGS. 1-7 show examples of an embodiment 100 using nested inserts with each cushion insert fitting within the bilobate aperture of the next larger cushion insert and the outermost cushion insert fitting within the bilobate cushion aperture. An embodiment 100 may optionally be used with no cushion inserts placed within the bilobate cushion aperture, or with one of the smaller cushion inserts placed within the bilobate cushion aperture without the cushion insert fitting against the interior surface of the cushion aperture and without a larger cushion insert intervening between the smaller cushion insert and the bilobate cushion aperture.

An optional releasable fastener 132 affixed to the interior surface 118 of the cushion aperture 104 is positioned to connect to the optional complementary releasable fastener 134 affixed to the outer surface 128 of the insert wall 126 for the first cushion insert 120 when the first cushion insert is positioned in the void space 252 of the cushion aperture. Some embodiments 100 omit the releasable fasteners. A first insert wall ridge 148 and an optional second insert wall ridge 148 extend toward one another inside the cushion insert aperture 154 for the first cushion insert 120. First and second arcuate insert aperture lobes 232 demarcated from one another by the intervening insert wall ridges have a size and shape selected to fit into the corresponding first and second arcuate cushion lobes 233. First and second channels 152 formed in the outer surface 128 of the insert wall 126 have a position and shape selected to admit the first and second cushion ridges 149.

An optional set of nesting inserts 204 includes the first cushion insert 120 and optionally includes the second cushion insert 122. A releasable fastener 132 affixed to the insert wall inner surface 130 of the first cushion insert 120 is positioned to connect to the complementary releasable fastener 134 affixed to the outer surface 128 of the insert wall 126 for the second cushion insert 122 when the second cushion insert is positioned in the void space 252 of the cushion insert aperture 154 in the first cushion insert 120. First and second insert wall ridges 148 extend toward one another inside the cushion insert aperture 156 for the second cushion insert 122. First and second arcuate insert aperture lobes 232 demarcated from one another by the intervening insert wall ridges have a size and shape selected to fit into the corresponding void space 252 surrounded by the first and second arcuate insert aperture lobes 232 of the first cushion insert 120. First and second channels 152 formed in the outer surface 128 of the insert wall 126 of the second cushion insert 122 have a position and shape selected to admit the first and second insert wall ridges 148 of the first cushion insert 120.

The optional set of nesting inserts 204 includes the third cushion insert 124. A releasable fastener 132 affixed to the insert wall inner surface 130 of the second cushion insert 122 is positioned to connect to the complementary releasable fastener 134 affixed to the outer surface 128 of the insert wall 126 for the third cushion insert 124 when the third cushion insert is positioned in the void space 252 of the cushion insert aperture 156 in the second cushion insert 122. First and second insert wall ridges 148 extend toward one another inside the cushion insert aperture 158 for the third cushion insert. First and second arcuate insert aperture lobes 232 demarcated from one another by the intervening insert wall ridges have a size and shape selected to fit into the corresponding void space 252 surrounded by the first and second arcuate insert aperture lobes 232 of the second cushion insert 122. First and second channels 152 formed in the outer surface 128 of the insert wall 126 of the third cushion insert 124 have a position and shape selected to admit the first and second insert wall ridges 148 of the second cushion insert 122.

FIG. 8 illustrates features included in the examples of cushion inserts of the previous figures. Features of the cushion inserts are configured to encourage a person reclining on the cushion assembly 100 to suspend a portion of either their buttocks or their breasts in the two laterally adjacent lobes of the void space 252 in the innermost cushion insert installed in the cushion aperture 104 of the cushion assembly 100, with the median plane of the person's body aligned with the longitudinal centerline 150 of the cushion aperture. The cushion inserts are further configured to position the longitudinal centerline of the cushion insert aperture to be coincident with the longitudinal centerline of the cushion aperture.

As suggested in the example of FIG. 8, each cushion insert, e.g., the first cushion insert 120, the second cushion insert 122, and the third cushion insert 124, includes a continuous insert wall 126 surrounding a void space 252. The insert wall 126 has an outer surface 128 and a smooth, continuous arcuate inner surface 130. In the example cushion assembly 100 embodiment of FIGS. 1-8, the insert wall outer surface 128 is formed with a bilobate outer perimeter 228. As will be discussed for FIG. 10 and FIG. 11, the insert wall outer perimeter 228 may alternatively be formed with rectangular, obround, or other shapes. The insert wall outer surface 128 and the insert wall inner surface 130 extend from an insert wall top surface 127 to an insert wall bottom surface 131 (ref. FIG. 3). The insert wall is shaped to form a first insert aperture lobe 232 on a first transverse side 236 of the longitudinal centerline 150 and a second insert aperture lobe 232 on a second transverse side 238 opposite the first transverse side. The insert wall inner surface 130 extends around both insert aperture lobes.

The intersection of the inner surface 130 with the insert wall top surface 127 forms the smooth, continuous, arcuate inner perimeter 230 of the insert wall. The insert wall outer surface 128 also extends around both insert aperture lobes, and the intersection of the insert wall outer surface 128 and the insert wall top surface 127 forms the smooth, continuous, arcuate insert wall outer perimeter 228 for the example cushion inserts in FIGS. 1-8. To form a set of nesting inserts 204, the outer perimeter 228 of each cushion insert preferably has the same smooth arcuate shape of the inner perimeter 230 of the next-outermost cushion insert, and the inner perimeter 230 is preferably the same smooth arcuate shape of the outer perimeter 228 of the next-innermost cushion insert. The void space 252 enclosed by the insert wall inner surface 130 in the example of FIG. 8 corresponds to the cushion insert aperture 154 of the first cushion insert 120, the cushion insert aperture 156 of the second cushion insert aperture 122, and the cushion insert aperture 158 of the third cushion insert 124.

The insert wall inner perimeter 230 is preferably formed as a smoothly-varying, continuous, uninterrupted curve around the bilobate insert aperture of each cushion insert. The arcuate profiles of the edges of the insert aperture lobes 232 and insert wall ridges 148 differ from perimeter shapes resulting from use of a commercially available product sometimes referred to as "pluck foam". Pluck foam divides a foam sheet into many square or rectangular blocks separable from one another along score lines cut into the sheet. An aperture with a square or rectangular perimeter can be formed by removing one or more blocks from the pluck foam sheet, but an aperture ideally having a smoothly curved perimeter will be approximated by a perimeter having many straight segments joined at projecting vertices. A person positioning themselves on the cushion may find it difficult to distinguish by touch between the many vertices around the perimeter of the insert aperture and the insert ridges projecting into the insert aperture. Furthermore, an insert ridge formed in a sheet of pluck foam may be inadvertently torn away when a person sits or reclines on the foam.

The insert wall is further formed with one, and optionally two, of the insert wall ridge 148 on longitudinally opposite sides of the void space 252. The convex arcuate surface of each insert wall ridge forms part of the insert wall inner surface 130 and the insert wall inner perimeter 230. The insert wall ridges protrude toward one another and extend from the insert wall top surface 127 toward the insert wall bottom surface 131. Each insert wall ridge is formed with a radius of curvature 224 having the center of curvature of the radius positioned on the longitudinal centerline 150. The insert wall 126 is also formed with one, and optionally two, of the insert wall channel in the insert wall outer surface 128. The concave arcuate surface of each insert wall channel forms part of the insert wall outer surface 128 and the insert wall outer perimeter 228. Each insert wall channel is formed with a radius of curvature 225 having its center of curvature positioned on the longitudinal centerline 150. The positioning of ridges and channels permits the ridge of a cushion insert to fit into the channel of the next-innermost cushion insert.

FIG. 8 further illustrates an example of a cushion insert having a wall thickness dimension 226 which varies at different locations round the outer perimeter 228. For a cushion insert with a bilobate outer perimeter 228 and a bilobate inner perimeter 230, a varying wall thickness 226 enables the radius of curvature 225 for the channel 152 and the radius of curvature 224 for the insert wall ridge 148 to be smaller than for a wall having uniform wall thickness all the way around the outer perimeter, particularly for the inner members of a set of nesting inserts. The outer transverse dimension 222 of the example cushion insert in FIG. 8 is preferably selected so that each cushion insert fits within the bilobate aperture of the next-outermost cushion insert.

Section B-B in FIG. 9 shows an example of a person reclining against the cushion top surface 106 of the example cushion assembly 100 of the previous figures. The person 200, represented by parts of a torso and thighs in silhouette, is positioned with part of their buttocks 202 suspended in the void space 252 of the cushion assembly. The part of the buttocks suspended in the void space corresponds to an example of a part of the body for which contact pressure with the cushion assembly is to be avoided. In the example of FIG. 9, the first cushion insert 120 is positioned in the cushion aperture 104, the second cushion insert 122 is positioned in the cushion insert aperture of the first cushion insert 120, and the third cushion insert of the previous examples has been omitted. The dimensions of the void space 252 have been reduced by the first and second cushion inserts to the dimensions of the insert wall inner surface 130 and the cushion insert aperture 156 for the second cushion insert 122. The insert wall ridges 148 extending into the void space 252 provide tactile guidance to the person for centering the median plane of their body in the cushion insert aperture 156.

The example cushion assembly 100 of the previous figures includes one or more cushion inserts having an insert wall with a bilobate insert wall outer perimeter 228 and a bilobate insert wall inner perimeter 230. The bilobate insert wall outer perimeter 228 fits within the bilobate cushion aperture perimeter 234 of the cushion aperture 104. As suggested in the examples of FIG. 10 and FIG. 11, the insert wall 126 of a cushion insert may alternatively be formed with a rectangular outer perimeter 228, an obround outer perimeter 228, or an outer perimeter having another shape, preferably including the bilobate insert aperture 154 and insert ridges 140 positioned on the longitudinal centerline 150 of the cushion aperture 104 as described for previous examples. A cushion insert with a rectangular outer perimeter fits within a cushion aperture 104 having a rectangular cushion aperture perimeter 234, a cushion insert with an obround outer perimeter fits within a cushion aperture having an obround cushion aperture perimeter, and so on for cushion inserts of other shapes.

Figure 2:
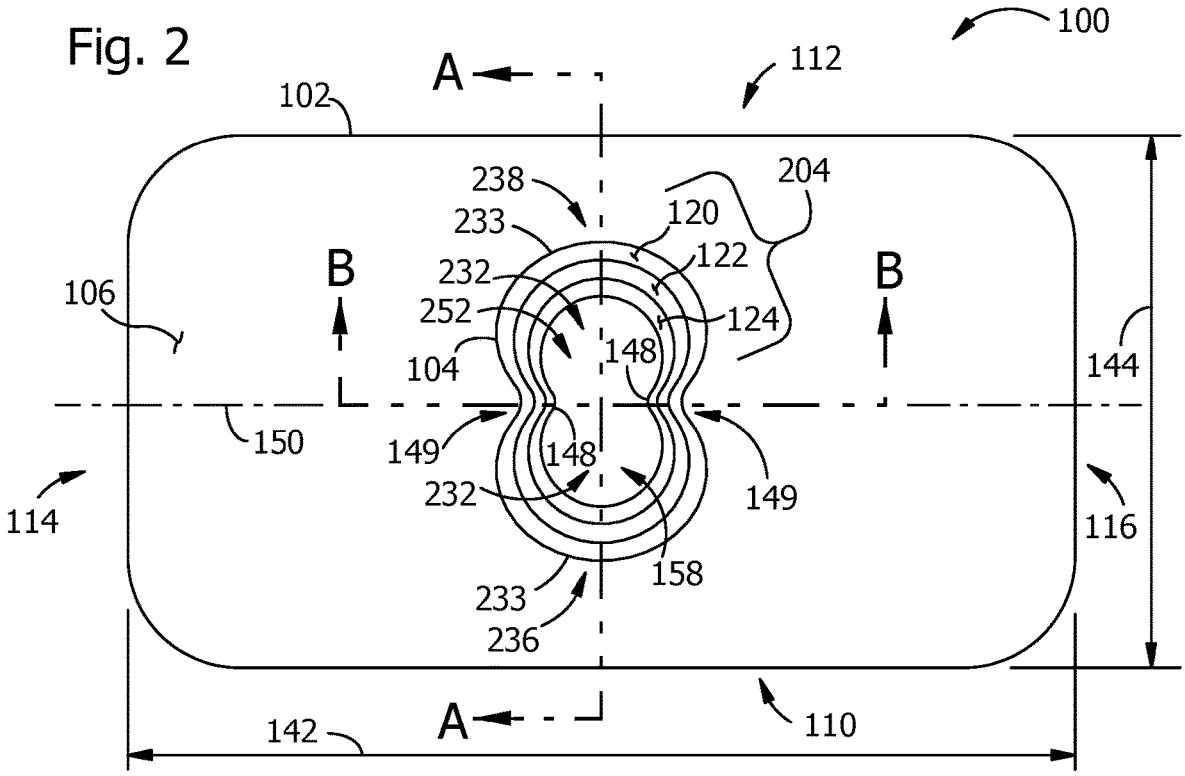
FIG. 2 a view toward the top surface of the example cushion assembly of FIG. 1.
Figure 12:
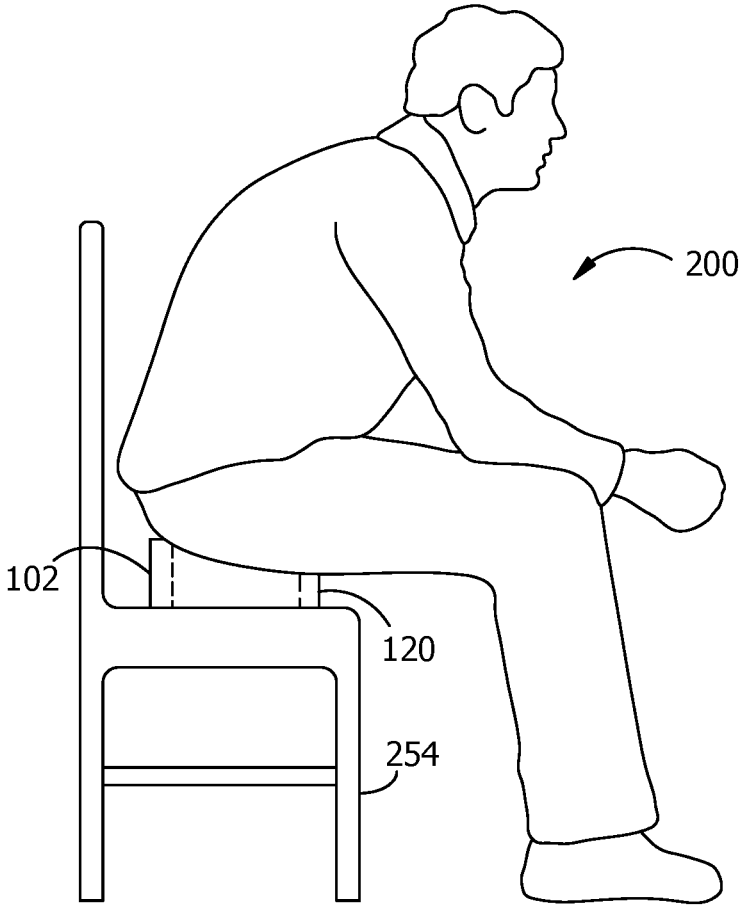
FIG. 12 is a side view of an example of a person sitting on a cushion insert placed on a chair without the use of the example cushion of FIG. 1.

As suggested in the examples of FIGS. 1, 2, and 9, the example cushion 102 may have outer length 142 and width 144 dimensions selected to provide a comfortable resting surface for supporting the torso of a reclining person. As suggested in the example of FIG. 12, a cushion 102 with a bilobate cushion aperture perimeter 234 (ref. FIG. 1 and FIG. 7 for examples) may have outer dimensions selected to enable placement of the cushion on the seating surface of a chair 254, wheelchair, bench, or car seat. FIG. 12 alternatively represents an example of a person 200 sitting on a cushion insert 120 placed against the seating surface of an example chair 254, without the use of the surrounding cushion 102 shown in other figures.

Unless expressly stated otherwise herein, ordinary terms have their corresponding ordinary meanings within the respective contexts of their presentations, and ordinary terms of art have their corresponding regular meanings.

What is claimed is:

1. An apparatus, comprising:

a cushion comprising a cushion top surface and a cushion bottom surface, said cushion formed with a cushion aperture extending through said cushion top surface toward said cushion bottom surface;

a cushion insert configured for insertion into said cushion aperture, comprising: an insert wall configured to fit within said cushion aperture, comprising:

an insert wall top surface;

an insert wall bottom surface, said insert wall formed with a bilobate insert aperture extending through said insert wall top surface toward said insert wall bottom surface; and an insert wall ridge projecting into said bilobate insert aperture, said insert wall ridge extending from said insert wall top surface toward said insert wall bottom surface.

2. The apparatus of claim 1, wherein said bilobate insert aperture is formed with a first insert aperture lobe extending transversely away from a first side of said insert wall ridge and a second insert aperture lobe extending transversely away from a second side of said insert wall ridge opposite said first side.

3. The apparatus of claim 1, wherein said cushion aperture is formed with a rectangular cushion aperture perimeter and said insert wall is formed with a rectangular insert wall outer perimeter configured to fit within said cushion aperture.

4. The apparatus of claim 1, wherein said cushion aperture is formed with an obround cushion aperture perimeter and said insert wall is formed with an obround insert wall outer perimeter configured to fit within said cushion aperture.

5. The apparatus of claim 1, said cushion further including a cushion ridge projecting into said cushion aperture from said cushion top surface toward said cushion bottom surface.

6. The apparatus of claim 5, wherein said cushion includes a second cushion ridge projecting into said cushion aperture from said cushion top surface toward said cushion bottom surface, with said cushion ridge and said second cushion ridge on longitudinally opposite sides of said cushion aperture.

7. The apparatus of claim 5, said cushion insert further including an insert wall outer surface formed with a channel extending from said insert wall top surface toward said insert wall bottom surface, and said channel positioned to receive said cushion ridge.

8. The apparatus of claim 7, wherein said cushion ridge, said insert wall ridge, and said channel are positioned on a longitudinal centerline of said cushion aperture when said cushion insert is positioned in said cushion aperture.

9. The apparatus of claim 1, wherein said cushion aperture is formed with a bilobate cushion aperture perimeter and said insert wall is formed with a bilobate insert wall outer perimeter configured to fit within said cushion aperture.

10. The apparatus of claim 9, wherein said cushion aperture is formed with a first cushion aperture lobe extending transversely away from a first side of said cushion ridge and a second cushion aperture lobe extending transversely away from a second side of said cushion ridge opposite said first side.

11. The apparatus of claim 9, wherein said cushion insert includes a second insert wall ridge projecting into said bilobate insert aperture, said second insert wall ridge extending from said insert wall top surface toward said insert wall bottom surface, and said insert wall ridge and said second insert wall ridge positioned on longitudinally opposite sides of said bilobate insert aperture.

12. The apparatus of claim 1, wherein said cushion aperture extends through said cushion bottom surface.

13. The apparatus of claim 1, further comprising:

a releasable fastener affixed to said cushion; and a complementary releasable fastener affixed to said insert wall, said complementary releasable fastener positioned to engage with said releasable fastener.

14. The apparatus of claim 1, said bilobate insert aperture having an inner surface with a vertical dimension less than a vertical dimension of said cushion.

15. The apparatus of claim 1, said bilobate insert aperture having an inner surface with a vertical dimension approximately equal to a vertical dimension of said cushion.

16. The apparatus of claim 1, wherein said cushion insert is a first cushion insert, and further comprising a second cushion insert positioned with an insert wall outer surface of said second cushion insert in contact with an inner surface of said bilobate insert aperture of said first cushion insert.

* * * * *